US006336668B1

(12) United States Patent
Bendel

(10) Patent No.: US 6,336,668 B1
(45) Date of Patent: Jan. 8, 2002

(54) MOTOR-VEHICLE DOOR LATCH WITH ADJUSTABLE LEVERS

(75) Inventor: Thorsten Bendel, Oberhausen (DE)

(73) Assignee: Kiekert AG, Heiligenhaus (DE)

( * ) Notice: Subject to any disclaimer, the term of this patent is extended or adjusted under 35 U.S.C. 154(b) by 0 days.

(21) Appl. No.: 09/540,342

(22) Filed: Mar. 31, 2000

(30) Foreign Application Priority Data

Apr. 10, 1999 (DE) ..... 299 06 391 U

(51) Int. Cl.[7] ..... E05B 65/20; E05C 3/26
(52) U.S. Cl. ..... 292/214; 292/DIG. 23
(58) Field of Search ..... 292/214, 216–219, 292/220, 223, DIG. 23, DIG. 53, DIG. 60, DIG. 64

(56) References Cited

U.S. PATENT DOCUMENTS 5,071,179 A 12/1991 Brackmann
5,603,539 A * 2/1997 Gruhn et al. ..... 292/216
5,622,396 A * 4/1997 Neumann ..... 292/202
6,024,389 A * 2/2000 Arabia, Jr. et al. ..... 292/216

FOREIGN PATENT DOCUMENTS

DE 40 05 369 9/1990

* cited by examiner

*Primary Examiner*—Christopher P. Schwartz
(74) *Attorney, Agent, or Firm*—Herbert Dubno Andrew Wilford

(57) ABSTRACT

A motor-vehicle door latch has a housing, a pair of levers pivoted at a common axis in the housing, a nut bearing axially on one of the levers and having a screwthread of a predetermined length, and a screw threaded in the nut, having a screwthread of a predetermined length, and having a head bearing axially oppositely on the other of the levers. Thus when the screw is tightened in the nut the two levers are locked together for joint pivoting. An abutment in the housing axially spaced from and confronting the nut is spaced from the nut by a predetermined distance equal to less than each of the predetermined screwthread lengths.

9 Claims, 1 Drawing Sheet

MOTOR-VEHICLE DOOR LATCH WITH ADJUSTABLE LEVERS

FIELD OF THE INVENTION

The present invention relates to a motor-vehicle door latch. More particularly this invention concerns such a latch having levers that, prior to finished installation, are movable relative to each other and that, after finished installation, are fixed relative to each other.

BACKGROUND OF THE INVENTION

A standard motor-vehicle door latch has a latch housing mounted on a door edge, a latch fork pivotal on the housing and latchingly engageable around a doorpost-mounted lock bolt, and a lock pawl mounted on the housing for retaining the fork latched around the bolt or releasing it to free the bolt. This pawl can be moved into the fork-freeing position by inside and outside door handles, and the outside handle at least can be decoupled from the pawl by locking mechanisms inside and outside the door. Typically the outside handle is pulled out to open the door, as such movement makes pulling the door open a natural extension of the unlatching operation. To this end a lever linkage is provided that couples the outside door handle to the lock pawl.

Since manufacturing tolerances will inherently vary, it is standard as described in German patent document 4,005,369 of D. Sajfert, U.S. Pat. No. 5,071,179 of H. Brackmann, and U.S. Pat. 5,622,396 of F. Neumann to provide in the linkage between one of the door handles, typically the outside handle, and the pawl a pair of levers which pivot about the same axis and which can be coupled or decoupled. Prior to the finished installation the two levers are decoupled and normally urged together or apart by one or more springs so they can be set to fit exactly between the handle and the pawl or mechanism by which they are connected to the pawl. Once the installation of the handle and latch is complete, these levers are attached together fixedly so that henceforth they pivot jointly as a single element.

The two levers are usually coupled by a screw that has a thread engaged in or operatively coupled to one of the levers and a head that can bear against the other lever. This screw is offset from the common pivot for the two levers so that when it is tightened they are fixed together for joint pivoting. Normally the latch is delivered to the installer with the screw tightened and the two levers in their maximum spread position. After installation the screw is loosened to set the desired relative angular position, and then retightened to lock it in.

Since this unscrewing and screwing work is typically done in a mass-production operation by a power driver, either pneumatic or battery-operated, it is easy for the installer to back out the screw so much that it comes completely out of the part it is screwed in. The installer need merely leave his or her finger on the trigger of the power driver a split second too long, and the screw is free and has dropped out of position, making it necessary to take apart the latch and reassemble it, or scrap the latch.

It has been suggested to overcome this problem by making the screw relatively long so that its end extends past the threaded sleeve it is seated in. After a washer is slipped over this exposed end, this end is overturned like a rivet to prevent the washer from slipping off. Thus when backed out the screw will stop when the washer engages the back of the sleeve or nut it is screwed into. The obvious disadvantages of this system is that it adds an extra part to the latch, requires an extra assembly step, and puts the extra weight of the washer and extra-long screw in the latch.

OBJECTS OF THE INVENTION

It is therefore an object of the present invention to provide an improved motor-vehicle door latch.

Another object is the provision of such an improved motor-vehicle door latch which overcomes the above-given disadvantages, that is which has levers whose relative positions can be fixed by a simple screw that cannot be lost, but that is no more complex than the simplest prior-art system.

SUMMARY OF THE INVENTION

A motor-vehicle door latch has according to the invention a housing, a pair of levers pivoted at a common axis in the housing, a nut bearing axially on one of the levers and having a screwthread of a predetermined length, and a screw threaded in the nut, having a screwthread of a predetermined length, and having a head bearing axially oppositely on the other of the levers. Thus, when the screw is tightened in the nut, the two an levers are locked together for joint pivoting. An abutment in the housing axially spaced from and confronting the nut is spaced from the nut by a predetermined distance equal to less than each of the predetermined screwthread lengths.

The abutment therefore prevents the screw from being screwed completely out of the nut. Of course means such as a second abutment is provided to prevent the nut, which is formed as a sort of a T-nut with a threaded sleeve, from being pushed out of the one lever. With this system the nut and screw cannot be separated from each other while the housing is intact.

The two screwthread lengths in accordance with the invention are about equal to each other. In addition the nut is a sleeve formed with a groove adapted to hold a spring. This spring can also serve to prevent the nut from rotating in the housing.

The housing according to the invention is formed of two parts joined on a plane substantially perpendicular to the axis. The abutment is formed on one of the parts with a hole centered on the axis and the screw has a formation engageable through the hole by a tool for rotation of the screw. More particularly, the housing is formed with an inwardly projecting frustoconical collar forming the hold and the abutment. Thus the installer simply fits the tip of his screwdriver through the hole so as to rotate the screw. The screw has a head of substantially greater diameter than a diameter of the hole so it cannot be backed out through the hole.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
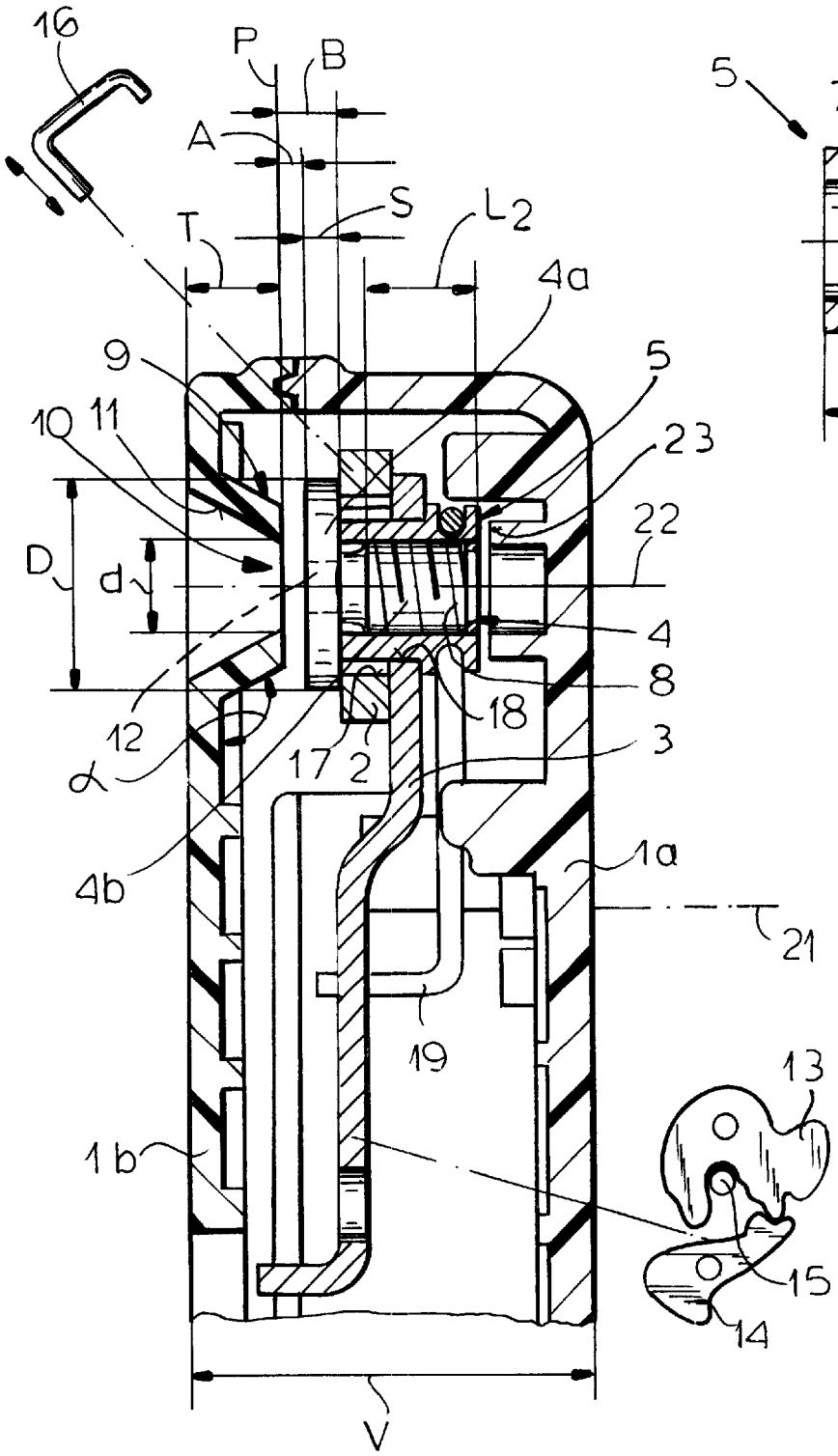
FIG. 1 is a partly diagrammatic sectional view of a latch according to the invention.
Figure 2:
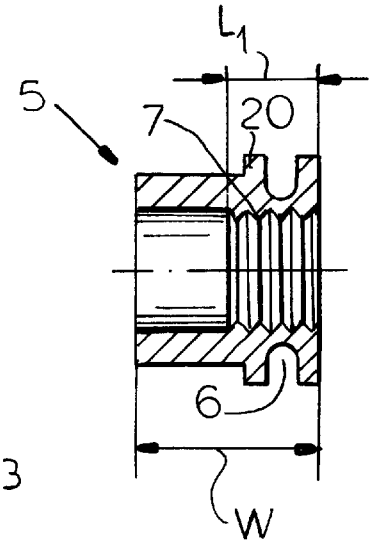
FIG. 2 is large-scale view of the anchor sleeve in accordance with the invention.

As seen in FIG. 1 a door latch 1 according to the invention has a pair of housing halves or shells 1*a* and 1*b* holding, along with other mechanism, an outside operating lever 2 connected to an outside handle 16 and a release lever 3 connected to a pawl 14 engageable around a lock fork 13 that can capture a standard door bolt 15. The two levers 2 and 3 are pivoted about a common axis shown generically at 21 and the lever 2 is formed with an arcuate slot 17 centered on the axis 21 and the lever 3 with a circular hole 18 centered on an axis 22. The two levers 2 and 3 are urged apart by a spring 19 but the hole 18 is always in line with some portion of the slot 17.

In accordance with the invention a screw 4 centered on the axis 22 has a head 4*a* bearing in one axial direction on the lever 2 and a threaded shank 4*b* threaded into a screwthread 7 of a sleeve nut 5 having a head 20 bearing axially oppositely on the lever 3. When the screw 4 and nut 5 are screwed tightly together, they press the two levers together 2 and 3 and cause them to pivot jointly about the axis 21. When loose, the two levers 2 and 3 can pivot independently of each other about the axis 21. The head 4*a* is formed with a recess 12 centered on the axis 22 and adapted to receive a tool, for instance an Allen wrench or screwdriver tip.

The two housing parts 1*a* and 1*b*, which can be made of a hard plastic or cast metal, inter fit in a tongue-and-groove joint at a plane P perpendicular to the axes 21 and 22. The part 1*b* is formed with a frustoconical abutment 9 centered on the axis 22 and forming a hole 10 of a diameter d smaller than a diameter D of the screw head 4*a*. The abutment 9 has a side angle $\alpha$ of between 120° and 140° so that an inner wall 11 forms an angle of between 40° and 60° to the axis 22. The head 20 of the screw nut 5 is formed with a radially outwardly open groove 6 in which the spring 19 is seated, the fit being such that the spring 19 prevents the nut 5 from turning about the axis 22. The housing half 1*a* is formed with an abutment or support 23 that is closely juxtaposed with the inside face of the nut 5 so that it cannot move axially and fall out of the hole 18.

The threaded portion 7 of the nut 5 has a length $L_1$ equal to the axial length $L_2$ of the threaded portion 8 of the screw 4. When the housing parts 1*a* and 1*b* are assembled, as illustrated, the planar face of the abutment 9 is separated by a space B from the confronting face of the lever 2, which distance B is equal to the sum of an axial dimension S of the head 4*a* and a dimension A of the axial space between the outer face of the screw head 4*a* and the inner face of the abutment 9. The housing 1*a*, 1*b* has an overall axial dimension V, the sleeve nut 5 has an axial length @, and the inner face of the abutment 9 is spaced inward from the outer face of the housing half 1*b* by a distance T. Thus A=B−S and T+B+W<V.

It is critical to the invention that the distance A be less then the longer of the dimensions $L_1$ or $L_2$. Thus when the screw 4 is backed out, it will hit the abutment 9 and stop well before its screwthread 8 disengages from the screwthread 7 of the nut 5.

The latch 1 is delivered to the installer with the screw 4 loosely threaded in the nut 5. After the latch 1 is installed in a door, the handle 16 is installed and will push in the lever 2 to some intermediate position. Then the installer inserts a tool through the hole 10 and tightens the screw 4 to lock the two levers 2 and 3 together. If the setting is bad the installer can back the screw 4 out, reset the handle 16, and tighten the screw 4 again.

I claim:

1. A motor-vehicle door latch comprising:

a housing;

a pair of levers pivoted at a common axis in the housing;

a nut bearing axially on one of the levers and having a screwthread of a predetermined length;

a screw threaded in the nut, having a screwthread of a predetermined length, and having a head bearing axially oppositely on the other of the levers, whereby when the screw is tightened in the nut the two levers are locked together for joint pivoting;

an abutment in the housing axially spaced from and confronting the nut and spaced from the nut by a predetermined distance equal to less than each of the predetermined screwthread lengths.

2. The motor-vehicle door latch defined in claim 1 wherein the two screwthread lengths are about equal to each other.

3. The motor-vehicle door latch defined in claim 1 wherein the nut is a sleeve formed with a groove adapted to hold a spring.

4. The motor-vehicle door latch defined in claim 1 wherein the housing is formed of two parts joined on a plane substantially perpendicular to the axis.

5. The motor-vehicle door latch defined in claim 1 wherein the abutment is formed with a hole centered on the axis and the screw has a formation engageable through the hole by a tool for rotation of the screw.

6. The motor-vehicle door latch defined in claim 5 wherein the housing is formed with an inwardly projecting frustoconical collar forming the hold and the abutment.

7. The motor-vehicle door latch defined in claim 5 wherein the screw has a head of substantially greater diameter than a diameter of the hole.

8. The motor-vehicle door latch defined in claim 1, further comprising a second abutment engageable with the nut and substantially preventing it from moving axially away from the screw.

9. The motor-vehicle door latch defined in claim 1 wherein the nut has a sleeve and the one lever has a circular hole snugly receiving the sleeve, the other lever having a slot through which the screw engages.

* * * * *